United States Patent [19]

Takata

[11] Patent Number: 4,464,816

[45] Date of Patent: Aug. 14, 1984

[54] SIZED WARP DIVIDER FOR A SIZING MACHINE

[75] Inventor: Akira Takata, Ishikawa, Japan

[73] Assignee: Tsudakoma Kogyo Kabushiki Kaisha, Japan

[21] Appl. No.: 207,995

[22] Filed: Nov. 18, 1980

[30] Foreign Application Priority Data

Nov. 21, 1978 [JP] Japan ..... 54-151404

[51] Int. Cl.[3] ..... D06B 3/04

[52] U.S. Cl. ..... 28/183; 118/104

[58] Field of Search ..... 28/178, 181, 182, 183, 28/212; 118/104; 134/104, 69 R; 15/256.51

[56] References Cited

U.S. PATENT DOCUMENTS

| | | | |
|---|---|---|---|
| 2,886,878 | 5/1959 | Schulze | 28/182 |
| 3,732,603 | 5/1973 | Illman et al. | 28/183 X |
| 3,779,207 | 12/1973 | Benson et al. | 28/212 X |
| 3,878,813 | 4/1975 | Roberson et al. | 118/104 |
| 3,916,475 | 11/1975 | Wilford | 15/256.51 |

FOREIGN PATENT DOCUMENTS

| | | | |
|---|---|---|---|
| 1551733 | 11/1968 | France | 28/212 |
| 489150 | 3/1973 | Japan . | |
| 14350 | of 1910 | United Kingdom | 28/212 |
| 1022112 | 3/1966 | United Kingdom | 28/212 |
| 317183 | 12/1971 | U.S.S.R. | 28/178 |

*Primary Examiner*—Robert Mackey

*Attorney, Agent, or Firm*—Lerner, David, Littenberg, Krumholz & Mentlik

[57] ABSTRACT

A sized warp divider of a rotary divider disc type is provided with a wash bath containing flow of liquid for partial immersion of the discs for removal of size dregs and fluffs, and an air jet ejector for removal of liquid drops remaining in spaces between the discs after the immersion for even sizing and drying effects on warps. Beautifully cleaned faces of the discs assures smooth and ideal contact with the running warps, thereby greatly improving the quality of the product and efficiency of the process.

10 Claims, 4 Drawing Figures

SIZED WARP DIVIDER FOR A SIZING MACHINE

BACKGROUND OF THE INVENTION

The present invention relates to an improved sized warp divider for a sizing machine, and more particularly relates to an improved construction of a sized warp divider in which sized warps are horizontally divided during passage through spaces formed by coaxially juxtaposed rotary divider discs.

Generally on a sizing machine, warps are delivered from warp beams in the supply station, passed through a sizing bath provided with immersion and squeeze rollers, and led to a dryer station after dividing by a suitable sized warp divider arranged between the sizing and dryer stations of the sizing machine.

For dividing of sized warps, the conventional warp divider is provided with a transverse divider rod arranged horizontally across the travelling path of the warps and a transverse comb arranged horizontally on the downstream side of the dividing rod. The upstream dividing rod divides the warps vertically into upper and lower warp sheets whereas the teeth of the downstream comb divide the warp sheets horizontally into individual, juxtaposed warps. Since warp dividing is carried out when the warps are still in a wet state, liquid size on the warps clings to the dividing rod and the teeth of the comb and is solidified by the heat from the dryer station which is usually located very close to the sizing station of the machine. Solidified size dregs on the dividing rod and the teeth of the comb seriously damage the warps which have running contact with these elements.

In order to obviate such a trouble, a new type of warp divider is disclosed in the Japanese Utility Model Publication Sho. 48-9150. This new arrangement includes a plurality of juxtaposed divider discs mounted to a rotary shaft which extends in a direction normal to the travelling direction of warps so that a warp or warps pass through a spaoe between adjacent divider discs. Water is sprayed on the divider discs in order to prevent solidification by heat of the liquid size clinging to the divider discs, thereby avoiding damage to the processed warps.

In this case, however, size dregs are always accumulated on the divider discs. These size dregs on the divider discs may often be taken over by the warps which have running contact with the divider discs, and are solidified while passing through the next-stage dryer station. Presence of such size dregs on the warps tends to cause frequent yarn breakgage during weaving and formation of weaving defects in the products.

In addition, forcible warp dividing by the divider discs blemished with size dregs promotes separation of fluffs from the warps and these fluffs cling to the faces of the divider discs which have sliding contact with the warps. This fluffs separation is remarkable in the case of spun yarns. Presence of such fluffs on the divider discs seriously damages the warps, in general and particularly when they are mixed with the size dregs.

SUMMARY OF THE INVENTION

It is an object of the present invention to provide a sized warp divider which greatly minimizes damage on warps caused during warp dividing on a sizing machine.

It is another object of the present invention to provide a sized warp divider capable of making fluffs, which have been caused by forcible warp dividing, lay flatly on the surface of the warps, this apparatus being particularly suited for sizing of spun yarns.

It is the still another object of the present invention to provide a divider disc type sized warp divider which well prevents uneven sizing and drying effects conventionally caused by presence of liquid drops in spaces between adjacent divider discs.

It is a further object of the present invention to provide a sized warp divider which assures ideal and complete warp dividing without any operational trouble such as yarn breakage during processing.

In accordance with the present invention, the sized warp divider includes a transverse rotary shaft arranged between the sizing and dryer sections of a sizing machine while extending in a direction substantially normal to the travelling direction of warps, and a plurality of parallel divider discs coaxially mounted on the rotary shaft at substantially equal intervals in an arrangement engageable with warps passing through spaces between adjacent divider discs. The level of the rotary shaft is chosen so that, as the rotary shaft is driven for operation, the circular section of each divider disc is sequentially placed in liquid in a wash bath arranged under the rotary shaft in which the liquid is forced to flow. The divider discs are accompanied with means for applying an air jets to the spaces between adjacent divider discs at a position over the level of the liquid.

Preferably, the driving system for the rotary shaft is separated, for independent operation control, from that for the sizing machine.

DESCRIPTION OF THE PREFERRED EMBODIMENT

Figure 1:
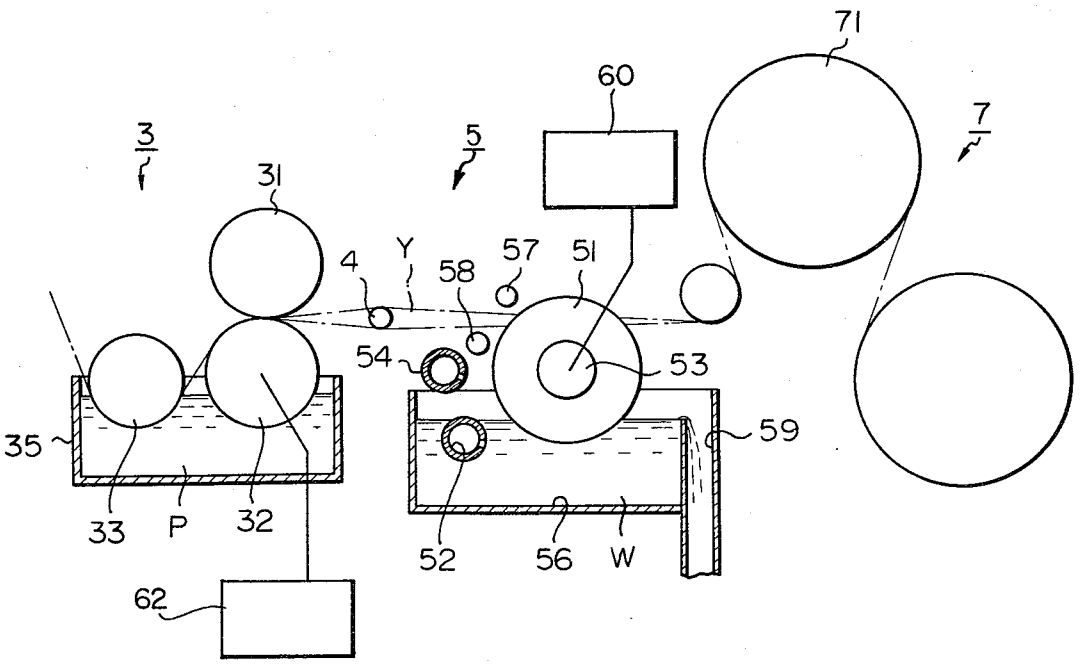
FIG. 1 is a side view, partly in section, of one embodiment of the sized warp divider in accordance with the present invention and its related parts of a sizing machine.
Figure 2:
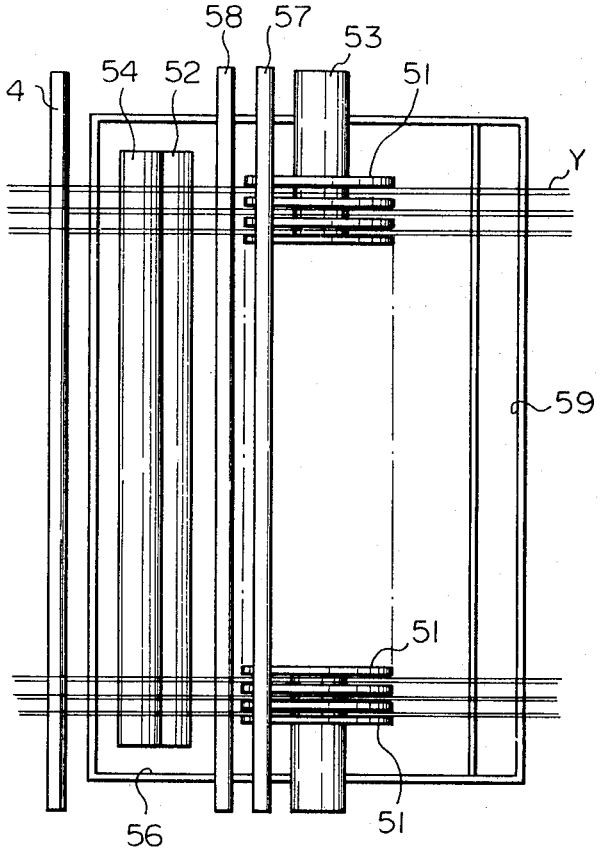
FIG. 2 is a plan view of the sized warp divider shown in FIG. 1.
Figure 3:
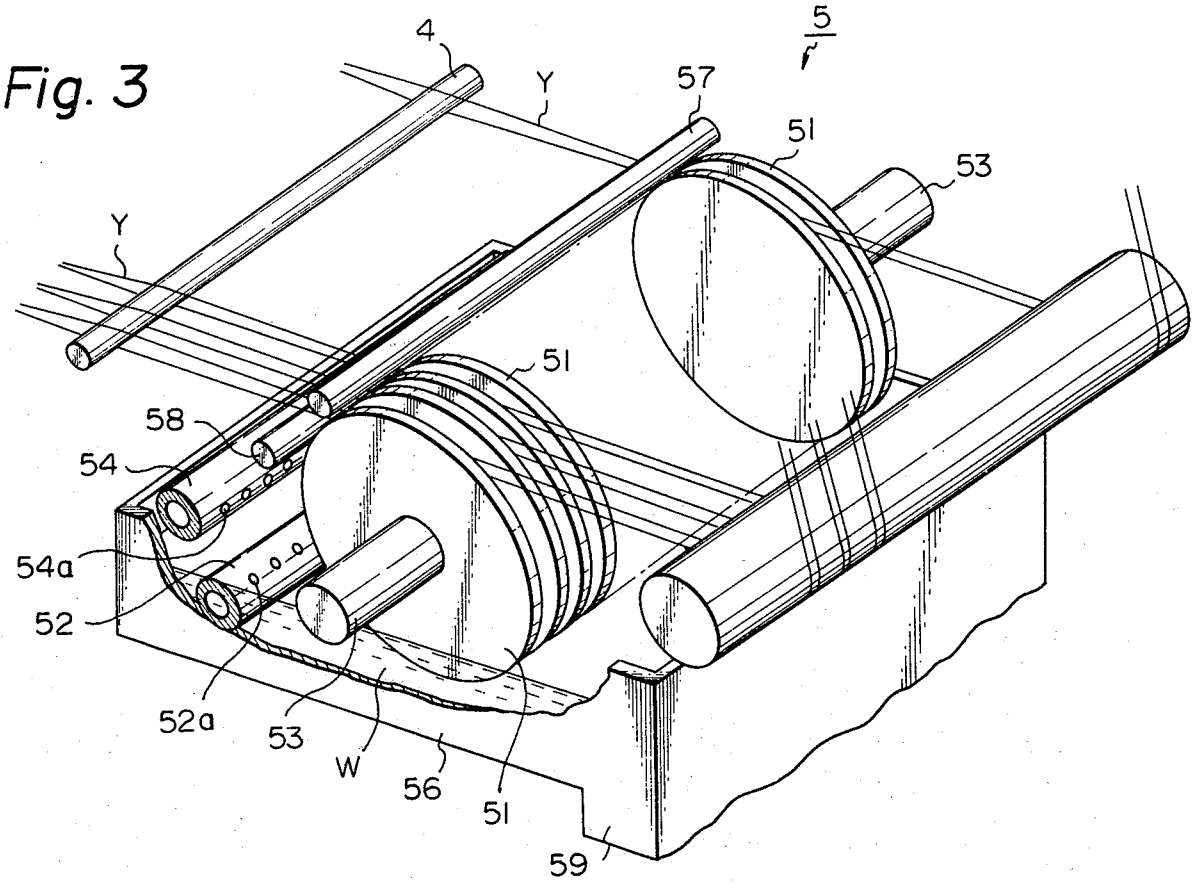
FIG. 3 is a perspective view, partly removed and omitted for easy understanding, of the sized warp divider shown in FIG. 1.

One embodiment of the sized warp divider 5 in accordance with the present invention is shown with its related parts of the sizing machine in FIGS. 1 through 3.

In the arrangement shown in FIG. 1, warps Y to be sized are delivered from warp beams (not shown), arranged in the supply station of the sizing machine, and are led to the sizing station 3, in which the warps Y are dipped by an immersion roller 33 in a size bath P within a sizing box 35. After the immersion, the warps Y are passed through the nip between a pair of squeezing rollers 31 and 32 for removal of excessive size, and are divided into upper and lower sheets by a dividing rod 4 extending transversely across the travelling path of the warps.

The warps Y, divided into two sheets, are then led to the sized warp divider 5 of the present invention. After division by the divider 5, the warps Y are further led to the dryer station 7 of the sizing machine, in which heated drums 71 are arranged.

Thus, the sized warp divider 5 of the present invention is arranged on the upstream side of the dryer station 7 along the travelling path of the warps Y. The warp divider 5 includes a wash bath 56, containing proper liquid W such as water, which is arranged under the travelling path of the warps Y. The warp divider 5 further includes a rotary shaft 53 extending in the width direction of the warp sheets. A plurality of parallel divider discs 51 are coaxially secured to the roatry shaft 53 at equal intervals, while extending in the travelling direction of the warp sheet. The dimension of the intervals should properly be designed in accordance with the warp density on the sizing machine. In practice, the distance between adjacent divider discs 51 should preferably be in a range from 1.4 to 4 mm. in order to allow free passage of one or two warps Y. The level of the rotary shaft 53 is designed so that the warps Y pass the space between adjacent discs 51, partly in contact with the divider discs 51, at a level of about two-thirds of the radius of the divider discs 51 above the axis of the rotary shaft 53. In practice, the warp sheet level is about 50 mm. above the axis of the rotary shaft 53 when the diameter of the divider disc 51 is about 75 mm.

The level of the rotary shaft 53 is further designed so that the circular section of each divider disc 51, which contacts with the warp or warps Y passing by, should sequentially be placed under the level of the liquid W in the wash bath 56 when the divider discs 51 rotate with the shaft 53 in the travelling direction of the warps Y and the diametral section comes on the lower side of the rotary shaft 53. Thus, size dregs and fluffs taken over by the divider discs 51 through contact with the warps Y are removed therefrom through contact with the liquid W in the bath 53 as the discs 51 rotate with the shaft 53.

As a consequence, the liquid W in the bath 56 is contaminated with the size dregs and fluffs falling off the divider discs 51 on the shaft 53. In order to prevent such contamination of the liquid W, fresh liquid has to be always supplied into the wash bath 56 and the size dregs and fluffs have to be always removed from the wash bath 56. To this end, a liquid supply tube 52 is arranged within the wash bath 56 at a position below the level of the liquid W and in parallel to the rotary shaft 53. The liquid supply tube 52 is provided with a plurality of radial openings 52*a* directed towards the divider discs 51 on the shaft 53 for formation of jet flow within the bath 56. On the side of the divider discs 51 opposite to the liquid supply tube 52, an overflow drain 59 is arranged within the wash bath 56 for constant discharge of liquid contaminated with size dregs and fluffs outside the wash bath 56. It should be appreciated that the jet flow generated by the liquid supply tube 52 completely removes size dregs and fluffs on the divider discs 51 into the liquid W within the wash bath 56.

After removal of size dregs and fluffs within the wash bath 56, the diametral section of each divider disc 51 leaves the level of the liquid as the divider discs 51 further rotate. Due to the extremely small distance between adjacent divider discs 51, the space between the adjacent divider discs 51 may contain liquid drops formed by surface tension of the liquid W even after its separation from the liquid W in the wash bath 56.

Presence of such liquid drops in the space between adjacent divider discs 51 is liable to cause surplus adsorption of the liquid W by the warp or warps Y passing through the space. This surplus adsorption of liquid leads to variation of size at the spots of the warps Y where the liquid is adsorbed and uneven drying in the next-staged dryer station 7.

In order to prevent presence of such liquid drops in the space between adjacent divider discs 51, the warp divider 5 in accordance with the present invention further includes an air ejection tube 54 arranged in parallel to the rotary shaft 53 and just above the level of the liquid W in the wash bath 56. Further, the air ejection tube 54 is located on the upstream side of the divider discs 51 on the shaft 53, and provided with a plurality of openings directed towards the divider discs 51 for ejection of air jet flow, thereby blowing off liquid drops in the spaces between the divider discs 51 before contact of the divider discs 51 with the warps Y.

The warps Y from the sizing station 3 are vertically divided by the dividing rod 4 into the upper and lower sheets and introduced into the warp divider 5 of the present invention in order to be further horizontally divided into individual warps Y by passage through the spaces between the cleaned divider discs 51 on the rotary shaft 53. During this horizontal dividing, insufficient tension on adjacent warps may cause the warps to climb over the top periphery of an assooiated divider disc 51 and the warps are not divided horizontally into individual warps. In order to prevent such faulty dividing, a barring rod 57 is arranged in parallel to the rotary shaft 53, on the upstream side of the divider discs 51 and at a level above the warp sheets and below the top peripheries of the divider discs 51. This barring rod 57 effectively blocks excessive upward movement of the warps Y travelling through the warp divider 5.

Figure 4:
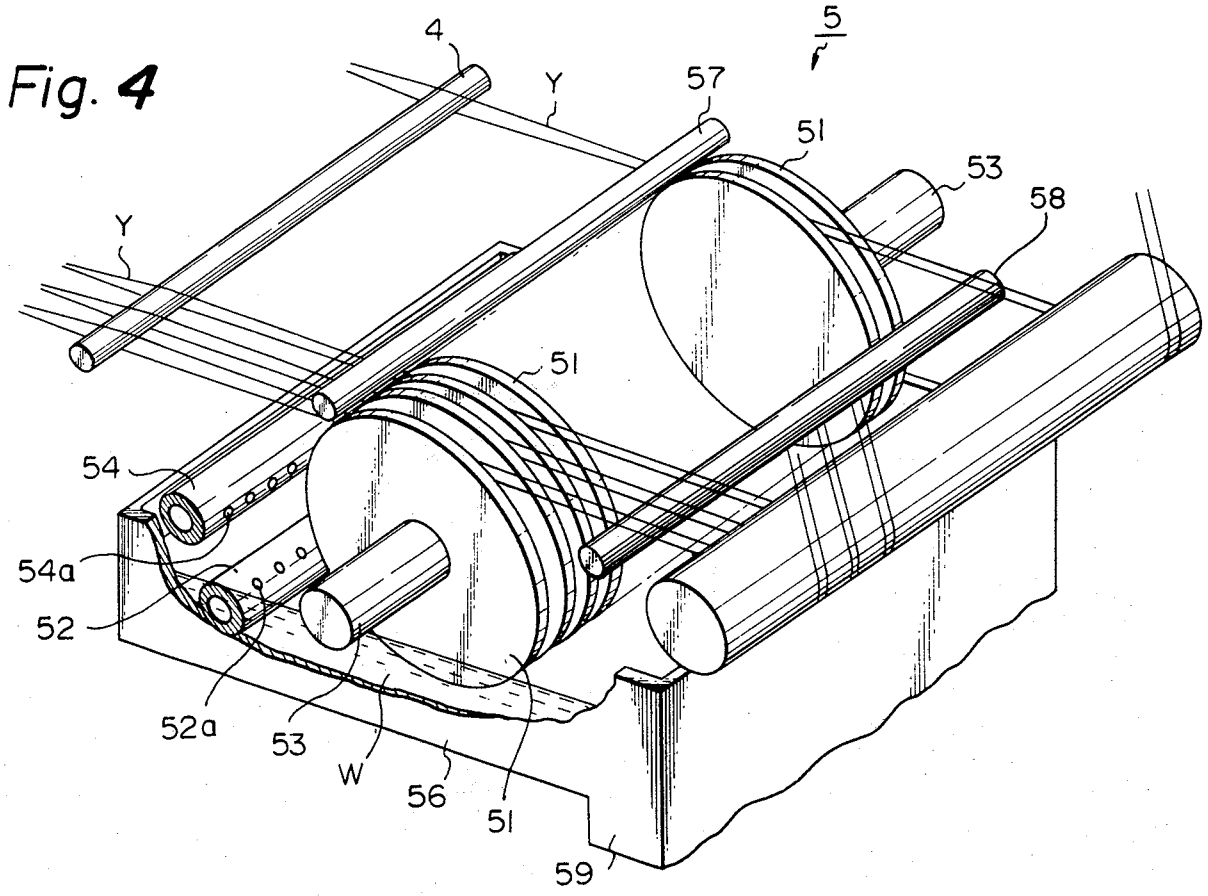
FIG. 4 is a perspective view, partly removed and omitted for easy understanding, of the sized warp divider shown in FIG. 1 including an alternate arrangement for the barring rod of the present invention.

In practice, the divider discs 51 are driven for rotation at a rotation speed about 0.3 to 3 RPM. Any enexpected happening during sizing operation may cause the warps Y to move downwards and be caught by the rotary shaft 53. In order to prevent this trouble, a second barring rod 58 is arranged in parallel to the rotary shaft 53, on the upstream side of the divider discs 51 and at a level below the warp sheets. This second barring rod 58 effectively blocks excessive downward movement of the warps Y travelling through the warp divider 5. As for the location of this second barring rod 58, it may be arranged on the downstream side of the divider discs 51 as shown in FIG. 4.

The driving system 60 for the warp divider 5, in accordance with the present invention, should preferably be separated from that for the sizing machine so the driving system 62 its operation can be controlled independently of the driving of the sizing machine. In practice, the warp divider 5 is driven for movement simultaneously with initiation of running of the sizing machine. When the sizing machine has ceased its running, the warp divider 5 stops its movement with a prescribed time-lag.

Water is advantageously used for the liquid W in the wash bath 56. The water may contain any suitable agent or agents effective for removal of size dregs and fluffs from the divider discs 51.

It was confirmed through practice by the inventor of the present invention that the following advantages are assured by use of the sized warp divider in accordance with the present invention:

(a) Size dregs and fluffs are removed off the discs by the liquid in the wash bath before horizontal dividing of the warps. Consequently, the sized warps always come into contact with clean and smooth side faces of the divider discs, thereby avoiding damages on the warps.

(b) Since the warps contact the clean and moderately wet side faces of the divider discs, fluffs generated by warp dividing are made to lie flatly on the surface of warps, thereby assuring production of high quality sized yarns. This advantage should particularly be appreciated in the case of spun yarns.

(c) Liquid drops in the space between adjacent divider discs are completely removed by pneumatic blow in advance to passage of the warps therethrough. This effectively avoids the danger of uneven size content or drying effects on the warps processed, thereby greatly minimizing yarn breakage during weaving operations and greatly minimizing formation of weaving defects.

(d) Use of the barring rods effectively prevents faulty dividing of warps and breakage of warps which are otherwise caused by excessive vertical movement of the warps. This greatly contributes to the running efficiency of sizing machines and the yield of sized warps.

(e) Use of the independent driving system for the warp divider enables the divider discs to rotate over a prescribed period even after the sizing machine has stopped running. Due to this continued rotation of the divider discs, size dregs and fluffs adhering to the divider discs can be completely removed before solidification. As a consequence, the faces of the divider discs are kept very clean and smooth at restarting of the sizing machine, thereby avoiding the danger of yarn breakage which otherwise is caused by presence of solidified size dregs and fluffs left on the divider discs. What I claim is:

1. An improved sized warp divider for a sizing machine comprising a wash bath arranged under the travelling path of sized warps at a position between sizing and dryer stations of said sizing machine, said wash bath containing a liquid, a transverse rotary shaft arranged over said wash bath and extending in a direction substantially normal to the travelling direction of said sized warps, a driving system coupled to said rotary shaft, a plurality of parallel divider discs coaxially mounted on said rotary shaft at substantially equal intervals in an arrangement engageable with said sized warps at a level over said rotary shaft as they pass through spaces defined by said divider discs, said divider discs extending substantially in said travelling direction of said sized warps, means for generating jet flow of said liquid in a direction substantially opposite to the rotating direction of said divider discs in said wash bath, and means for applying an air jet to said spaces between said divider discs at a position over the level of said liquid in said wash bath on the upstream side of the area of engagement of said divider discs with said sized warps, said air jet for blowing undesired drops of said liquid off said spaces, the level of said rotary shaft being chosen so that, as said rotary shaft is driven for operation, the circular section of each divider disc is sequentially placed in said liquid for washing.

2. An improved sized warp divider as claimed in claim 1 further comprising means for automatically draining the excessive amount of said liquid out of said wash bath.

3. An improved sized warp divider as claimed in claim 2 in which said draining means includes an overflow drain opening in said wash bath.

4. An improved sized warp divider as claimed in claim 1 further comprising means for limitting excessive vertical displacement of said sized warps in the region of said divider discs.

5. An improved sized warp divider as claimed in claim 4 in which said limitting means includes at least a barring rod arranged on the upstream side of said divider discs at a level between the top peripheries of said divider discs and said sized warps, and said barring rod extends in a direction crossing said travelling direction of said sized warps.

6. An improved sized warp divider as claimed in claim 4 or 5 in which said limitting means includes at least a barring rod arranged on said upstream side of said divider discs at a level between said rotary shaft and said sized warps, and said barring rod extends in a direction crossing said travelling direction of said sized warps.

7. An improved sized warp divider as claimed in claim 4 or 5 in which said limiting means includes at least a barring rod arranged on the downstream side of divider discs at a level between said rotary shaft and said sized warps, and said barring rod extends in the direction crossing said traveling direction of said sized warps.

8. An improved sized warp divider as claimed in claim 1, 2 or 4 in which said air jet applying means includes at least an air ejection tube arranged in parallel to said rotary shaft at a position over said level of said liquid, provided with radial openings directed towards said divider discs, and connected to a given supply source of compressed air.

9. An improved sized warp divider as claimed in claims 1, 2, or 4 in which said sizing machine includes a driving system, said driving system for said rotary shaft operates independently of the driving system for said sizing machine.

10. An improved sized warp divider as claimed in claim 1, 2 or 4 in which said liquid flow generating means includes at least one liquid supply tube arranged in parallel to said rotary shaft at a position under said level of said liquid, provided with radial openings directed towards said divider rods, and connected to a given supply source of said liquid under pressure.

* * * * *